US009091967B2

(12) United States Patent
Hirai et al.

(10) Patent No.: US 9,091,967 B2
(45) Date of Patent: Jul. 28, 2015

(54) IMAGE FORMING APPARATUS

(71) Applicant: SHARP KABUSHIKI KAISHA, Osaka-shi, Osaka (JP)

(72) Inventors: Masashi Hirai, Osaka (JP); Masaki Saka, Osaka (JP); Toshiki Takiguchi, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 0 days.

(21) Appl. No.: 14/371,527

(22) PCT Filed: Jan. 9, 2013

(86) PCT No.: PCT/JP2013/050149
§ 371 (c)(1),
(2) Date: Jul. 10, 2014

(87) PCT Pub. No.: WO2013/105563
PCT Pub. Date: Jul. 18, 2013

(65) Prior Publication Data

US 2015/0153685 A1 Jun. 4, 2015

(30) Foreign Application Priority Data

Jan. 10, 2012 (JP) ..... 2012-001922
Jan. 10, 2012 (JP) ..... 2012-001923

(51) Int. Cl.
*G03G 15/01* (2006.01)
*G03G 15/16* (2006.01)

(52) U.S. Cl.
CPC .. *G03G 15/1615* (2013.01); *G03G 2215/00143* (2013.01); *G03G 2215/00151* (2013.01); *G03G 2215/00156* (2013.01)

(58) Field of Classification Search
CPC ..... G03G 2215/00143; G03G 2215/00151; G03G 2215/00156; G03G 15/1615
USPC ..... 399/302
See application file for complete search history.

(56) References Cited

U.S. PATENT DOCUMENTS

2006/0067745 A1* 3/2006 Yamada et al. ..... 399/302
(Continued)

FOREIGN PATENT DOCUMENTS

| | | | |
|---|---|---|---|
| JP | 2004-012585 | | 1/2004 |
| JP | 2004012585 A | * | 1/2004 |
| JP | 2004-037753 | | 2/2004 |
| JP | 2008-058429 | | 3/2008 |

(Continued)

OTHER PUBLICATIONS

International Search Report for PCT/JP2013/050149, mailed Mar. 19, 2013.

*Primary Examiner* — David Gray
*Assistant Examiner* — Tyler Hardman
(74) *Attorney, Agent, or Firm* — Nixon & Vanderhye, P.C.

(57) ABSTRACT

An image forming apparatus (100) is equipped with a plurality of photoreceptor drums (31A to 31D), an intermediate transfer belt (41), a separating and contacting mechanisms (20), a tension roller (44), a meandering correction mechanism, and a controller. The separating and contacting mechanism (20) displaces the intermediate transfer belt (41). The meandering correction mechanism increases and decreases a biasing force applied to each of the opposite end portions of the tension roller (44) according to the amount of movement of the intermediate transfer belt (41) in the axial direction (94) of the tension roller (44). The controller, during a non-image forming period, at a predetermined timing during rotation of the intermediate transfer belt (41), executes a belt displacement process in which the intermediate transfer belt (41) is displaced from a predetermined reference position and then returned to the reference position.

6 Claims, 10 Drawing Sheets

(56) References Cited

U.S. PATENT DOCUMENTS

| | | | | |
|---|---|---|---|---|
| 2006/0245782 | A1* | 11/2006 | Hirai et al. | 399/101 |
| 2008/0056778 | A1 | 3/2008 | Tao et al. | |
| 2013/0061698 | A1* | 3/2013 | Izumi et al. | 74/55 |
| 2013/0064581 | A1* | 3/2013 | Okamoto et al. | 399/302 |
| 2014/0169840 | A1* | 6/2014 | Yokoyama et al. | 399/298 |

FOREIGN PATENT DOCUMENTS

| | | | |
|---|---|---|---|
| JP | 2008-233196 | | 10/2008 |
| JP | 2009-151019 | | 7/2009 |
| JP | 2009151019 | A * | 7/2009 |
| JP | 2010-230958 | | 10/2010 |
| JP | 2010230958 | A * | 10/2010 |

* cited by examiner

IMAGE FORMING APPARATUS

This application is the U.S. national phase of International Application No. PCT/JP2013/050149 filed on 9 Jan. 2013 which designated the U.S. and claims priority to Japan Application No. 2012-001922, filed on 10 Jan. 2012; and Japan Application No. 2012-001923, filed on 10 Jan. 2012, the entire contents of each of which are hereby incorporated by reference.

TECHNICAL FIELD

The present invention relates to an image forming apparatus that transfers a toner image from a plurality of image bearing members onto a sheet of paper through an intermediate transfer belt.

BACKGROUND ART

Some electrophotographic image forming apparatuses include an intermediate transfer type image forming apparatus for primarily transferring a toner image from a plurality of image bearing members onto an intermediate transfer belt in a sequential overlapping manner, and then secondarily transferring the toner image from the intermediate transfer belt to a sheet of paper (see Patent Literature 1, for example). A color image forming apparatus displaces the intermediate transfer belt according to each of the operating states during monochrome image formation, during color image formation, and during non-image formation. The intermediate transfer belt is contacted only with an image bearing member for black color during the monochrome image formation, contacted with all of the image bearing members during the color image formation, and spaced away from all of the image bearing members during the non-image formation.

In conventional image forming apparatuses stated above, the meandering of the intermediate transfer belt may adversely affect the image quality during the image formation and, also during the non-image formation, may cause a widthwise end portion of the intermediate transfer belt to be bent by being strongly pressed against a flange portion of a stretching roller over which the intermediate transfer belt is stretched. Even during the non-image formation, when the widthwise end portion of the intermediate transfer belt bends, the image quality during image formation may be affected adversely. Therefore, it is important to suppress the meandering of the intermediate transfer belt.

CITATION LIST

Patent Literature

Patent Literature 1: Japanese Patent Laid-Open publication No. 2008-233196

SUMMARY OF INVENTION

Technical Problem

In view of the foregoing, as a meandering correction mechanism of an intermediate transfer belt, a following structure in which the meandering of the intermediate transfer belt is suppressed by adjusting a tensile force of the intermediate transfer belt by means of a mechanical system without using a sensor can be considered. More specifically, the meandering correction mechanism biases a tension roller in a direction in which the tensile force of the intermediate transfer belt is increased. In addition, the meandering correction mechanism includes a deviation transfer member moving in an axial direction by a deviation force of the intermediate transfer belt in the axial direction of the tension roller, and increases and decreases a biasing force applied to each of the opposite end portions of the tension roller according to an amount of movement in the axial direction of the deviation transfer member.

However, in the above-stated meandering correction mechanism, even in a case in which the meandering of the intermediate transfer belt occurs, when the deviation force is small, there is a risk that the deviation transfer member may not move in the axial direction, or a risk that a moving start timing may be delayed. The reason is that, in conventional image forming apparatuses, the intermediate transfer belt is not displaced from the reference position for a longer time during a non-image forming period as compared to during an image forming period, so that neither the intermediate transfer belt nor the tension roller vibrates and a static friction force may be applied to between the deviation transfer member and a shaft member and the like.

In spite that the meandering of the intermediate transfer belt has occurs, if the deviation transfer member does not move, or the moving start timing is delayed, the precision of meandering correction of the intermediate transfer belt decreases.

An object of the present invention is to provide an image forming apparatus capable of improving the precision of meandering correction of an intermediate transfer belt during a non-image forming period.

Solution to Problem

An image forming apparatus of the present invention is equipped with a plurality of image bearing members, an endless intermediate transfer belt, a separating and contacting mechanism, a plurality of stretching rollers, a meandering correction mechanism, and a controller. The image bearing members each bear a toner image. Onto the intermediate transfer belt is transferred the toner image from at least one of the plurality of image bearing members during image formation. The separating and contacting mechanism displaces the intermediate transfer belt to a separating and contacting direction with respect to each of the plurality of image bearing members. The stretching rollers stretch the intermediate transfer belt over the rollers. The stretching rollers include: a driving roller that rotates the intermediate transfer belt; and a tension roller of which the opposite end portions in an axial direction are independently movable in a direction in which a tensile force of the intermediate transfer belt is changed. The meandering correction mechanism biases the tension roller in the direction in which the tensile force of the intermediate transfer belt is increased. The meandering correction mechanism includes a deviation transfer member moving in the axial direction by the deviation force of the intermediate transfer belt in the axial direction of the tension roller, and increases and decreases a biasing force applied to each of the opposite end portions of the tension roller according to an amount of movement in the axial direction of the deviation transfer member. The controller, during a non-image forming period, at a predetermined timing during rotation of the intermediate transfer belt, executes a belt displacement process in which the separating and contacting mechanism is controlled so that the intermediate transfer belt is displaced from a predetermined reference position in which the intermediate transfer belt is spaced away from all of the plurality of image bearing members and then is returned to the reference position.

In this configuration, since, during the non-image forming period, at a predetermined timing during rotation of the intermediate transfer belt, the belt displacement process is executed, the tensile force of the intermediate transfer belt is changed and vibration is transmitted to the meandering correction mechanism. Therefore, even when the deviation force of the intermediate transfer belt is small, the deviation transfer member is easily moved by the deviation force of the intermediate transfer belt. Thus, according to the amount of movement in the axial direction of the deviation transfer member, the biasing force applied to each of the opposite end portions of the tension roller is precisely increased and decreased.

Advantageous Effects of Invention

The present invention makes it possible to improve the precision of meandering correction of an intermediate transfer belt during a non-image forming period.

BRIEF DESCRIPTION OF DRAWINGS

FIG. 2A illustrates a state during non-image formation, FIG. 2B illustrates a state during monochrome image formation, and FIG. 2C illustrates a state during color image formation.

FIG. 4A illustrates a state in which a primary transfer roller is in a separating position, and FIG. 4B illustrates a state in which the primary transfer roller is in a pressing position.

FIG. 6A illustrates a state during non-image formation, FIG. 6B illustrates a state during monochrome image formation, and FIG. 6C illustrates a state during color image formation.

DESCRIPTION OF EMBODIMENTS

Hereinafter, preferred embodiments of the present invention will be described with reference to the drawings.

Figure 1:
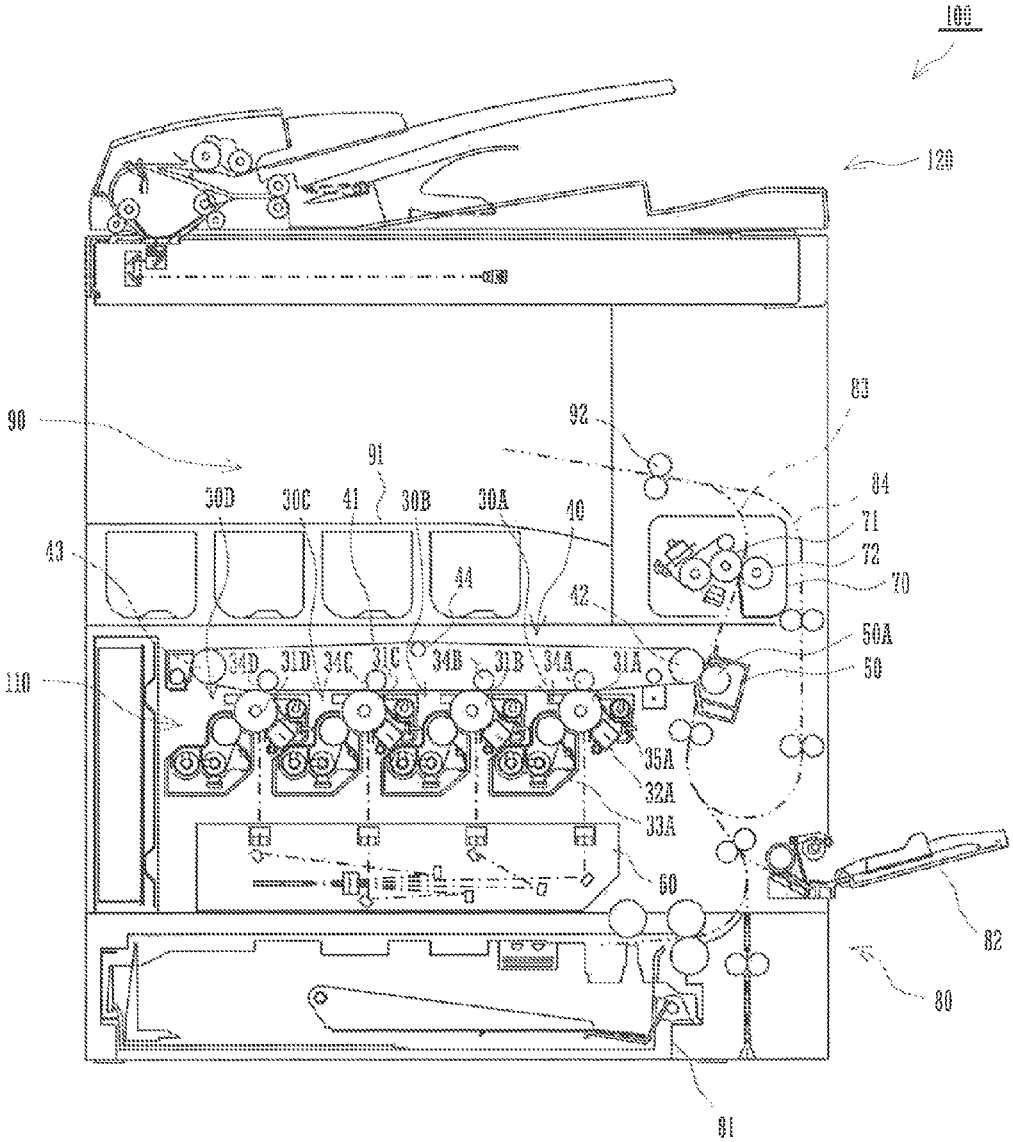
FIG. 1 is a schematic cross-sectional front view of an image forming apparatus according to a preferred embodiment of the present invention.

As shown in FIG. 1, an image forming apparatus 100 is configured to form a polychrome or monochrome image onto a predetermined sheet of paper based on image data that have been read from a document. The sheet of paper includes recording media such as plain paper, cardboard, photographic paper, and an OHP film. The image forming apparatus 100 includes an image reading portion 120, an image forming portion 110, a paper supply portion 80, and a paper discharge portion 90.

The image reading portion 120 irradiates the image bearing side of the document with light and generates image data by detecting the light quantity of reflected light.

The image forming portion 110 includes four image forming stations 30A, 30B, 30C, and 30D, an intermediate transfer unit 40, a secondary transfer unit 50, an exposure unit 60, and a fixing unit 70.

The intermediate transfer unit 40 includes an intermediate transfer belt 41 which is an endless belt, a first stretching roller 42, a second stretching roller 43, and a tension roller 44. The intermediate transfer belt 41 is made of a resin film having no stretch property, such as a polyimide film. The first stretching roller 42, the second stretching roller 43, and the tension roller 44 are arranged in parallel with each other. The first stretching roller 42, the second stretching roller 43, and the tension roller 44 stretch the intermediate transfer belt 41 over the rollers. By way of example, the first stretching roller 42 is a driving roller while the second stretching roller 43 is a driven roller.

The tension roller 44 is biased by a not-shown spring in a direction in which the tension roller is in pressure contact with an inner peripheral surface of the intermediate transfer belt 41. The tension roller 44 adjusts the tensile force of the intermediate transfer belt 41.

The image forming stations 30A to 30D each perform an electrophotographic image forming process using toners of respective colors of black, cyan, magenta and yellow. The image forming stations 30A to 30D are arranged side by side so as to be opposed to a predetermined region of the intermediate transfer belt 41. The image forming stations 30B to 30D are each configured in the same manner as the image forming station 30A.

The image forming station 30A is equipped with a monochrome image forming photoreceptor drum 31A that bears black toner. The image forming stations 30B, 30C, and 30D are equipped with color image forming photoreceptor drums 31B, 31C, and 31D that bear color toners, respectively. Each of the photoreceptor drums 31A to 31D forms an image bearing member.

The image forming station 30A includes a charging device 32A, a developing device 33A, a primary transfer roller 34A, and a cleaner device 35A that are disposed around the photoreceptor drum 31A. Similarly, the image forming stations 30B, 30C, and 30D include primary transfer rollers 34B, 34C, and 34D, respectively.

The photoreceptor drum 31A is rotated in a predetermined direction by a driving power transmitted from a not-shown driving source. The charging device 32A electrostatically charges the peripheral surface of the photoreceptor drum 31A to a predetermined potential.

The exposure unit 60 is configured to drive a semiconductor laser based on image data items corresponding to the respective colors of black, cyan, magenta and yellow to distribute laser light corresponding to the respective colors to each of the photoreceptor drums 31A to 31D of the image forming stations 30A to 30D. On the peripheral surfaces of the photoreceptor drums 31A to 31D, electrostatic latent images according to the image data items corresponding to the respective colors of black, cyan, magenta and yellow are formed.

The developing device 33A is configured to supply black toner that is the color of the image forming station 30A, onto the peripheral surface of the photoreceptor drum 31A, thereby visualizing the electrostatic latent image into a toner image.

The outer peripheral surface of the intermediate transfer belt 41 sequentially faces the photoreceptor drums 31A to 31D. The primary transfer roller 34A is arranged at a position opposed to the photoreceptor drum 31A across the intermediate transfer belt 41. The primary transfer roller 34B is arranged at a position opposed to the photoreceptor drum 31B across the intermediate transfer belt 41. The primary transfer roller 34C is arranged at a position opposed to the photoreceptor drum 31C across the intermediate transfer belt 41. The primary transfer roller 34D is arranged at a position opposed to the photoreceptor drum 31D across the intermediate transfer belt 41.

The primary transfer roller 34A primarily transfers the toner image born on the photoreceptor drum 31A onto the outer peripheral surface of the intermediate transfer belt 41 by being applied with a primary transfer bias of an opposite polarity (positive, for example) to the electrostatically charged polarity (negative, for example) of the toner.

Residual toner remaining on the outer peripheral surface of the photoreceptor drum 31A is removed by the cleaner device 35A.

During monochrome image formation, only the monochrome image forming station 30A performs the image forming process described above. In addition, during full-color image formation, the image forming stations 30B to 30D as well as the image forming station 30A perform the same process for the respective colors of cyan, magenta and yellow, as does the image forming station 30A. The resulting toner images of the respective colors of black, cyan, magenta and yellow are, by the respective intermediate transfer rollers 34A to 34D of the image forming stations 30A to 30D applied with the primary transfer bias, sequentially transferred onto the outer peripheral surface of the intermediate transfer belt 41 so as to be superimposed on one another to form one image.

The paper supply portion 130 is equipped with a paper supply cassette 81, a manual feed tray 82, a main sheet feed path 83, and a subsidiary sheet feed path 84. In the paper supply cassette 81, a plurality of sheets of paper of a size and kind with a relatively high frequency in use are stored. On the manual feed tray 82, a plurality of sheets of paper of a size and kind with a relatively low frequency in use are placed.

The main sheet feed path 83 is formed to extend from the paper supply cassette 81 and the manual supply tray 82 to the paper discharge portion 90 by passing between the intermediate transfer belt 41 and the secondary transfer unit 50 and through the fixing unit 70. The subsidiary sheet feed path 84, which is a sheet feed path for double-sided image formation, is formed in such a manner a sheet bearing an image formed on one side of sheet is turned upside down and then fed to between the intermediate transfer belt 41 and the secondary transfer unit 50 again.

The secondary transfer unit 50 has a secondary transfer roller 50A. The secondary transfer roller 50A transfers the toner image born on the outer peripheral surface of the intermediate transfer belt 41 onto a sheet of paper by being applied with a secondary transfer bias of an opposite polarity (positive, for example) to the electrostatically charged polarity (negative, for example) of the toner.

The fixing unit 70 has a fixing roller 71 and a pressurizing roller 72 and, by heating and pressurizing the sheet onto which the toner image has been transferred, fixes the toner image on the sheet of paper.

The paper discharge portion 90 is equipped with a paper discharge tray 91 and a paper discharge roller 92. The sheet on which the toner image is fixed is discharged to the paper discharge tray 91 by the paper discharge roller 92. The sheet is stored in the paper discharge tray 91 with a side of the sheet on which the toner image is fixed facing down.

Figure 2A:
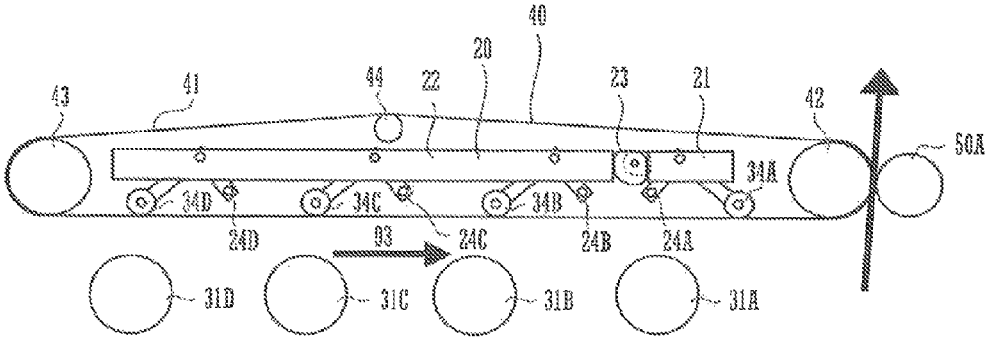
FIGS. 2A, 2B, and 2C are front views schematically illustrating the configuration of an intermediate transfer unit.
Figure 2B:
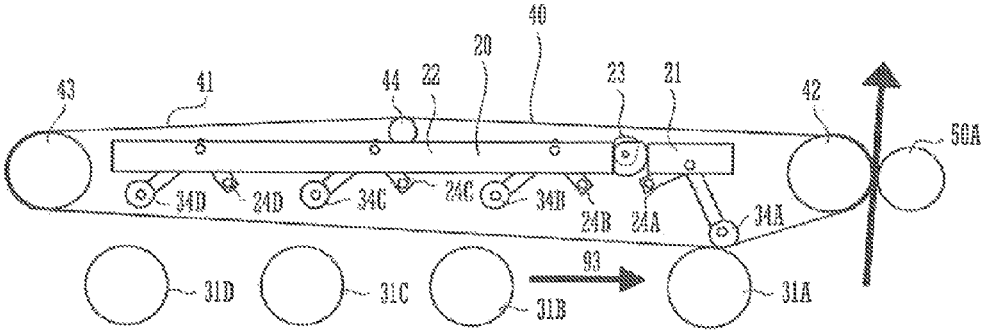
Figure 2C:
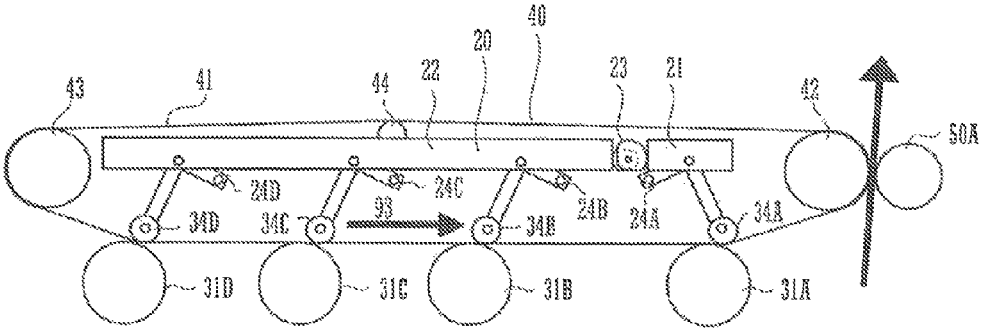

As shown in FIG. 2A to FIG. 2C, the intermediate transfer belt 41 is stretched over the first stretching roller 42 and the second stretching roller 43 to form a predetermined loop-shaped moving path. Along the outer peripheral surface of the intermediate transfer belt 41 the photoreceptor drum 31D, the photoreceptor drum 31C, the photoreceptor drum 31B and the photoreceptor drum 31A are arranged sequentially from the upstream side in a moving direction 93 of the intermediate transfer belt 41 within a region opposed to the photoreceptor drums 31A to 31D. In the moving direction 93, the first stretching roller 42 is arranged on the downstream side and the second stretching roller 43 is arranged on the upstream side. As described above, the primary transfer rollers 34A to 34D are arranged at positions opposed to the respective photoreceptor drums 31A to 31D across the intermediate transfer belt 41. In the present preferred embodiment, the intermediate transfer belt 41 is positioned above the photoreceptor drums 34A to 34D.

The primary transfer rollers 34A to 34D are configured to be freely displaceable in a separating and contacting direction with respect to the photoreceptor drums 31A to 31D that are opposed to the primary transfer rollers 34A to 34D, respectively. This enables the primary transfer roller 34A to be freely displaced at least between a pressing position in which the primary transfer roller 34A presses the intermediate transfer belt 41 against the photoreceptor drum 31A opposed to the primary transfer roller 34A and a separating position in which the primary transfer roller 34A separates the intermediate transfer belt 41 from the photoreceptor drum 31A opposed to the primary transfer roller 34A. The primary transfer rollers 34B to 34D are similar to the primary transfer roller 34A.

As shown in FIG. 2A, during non-image formation, all the primary transfer rollers 34A to 34D are arranged in the respective separating positions and, thus, the intermediate transfer belt 41 is arranged at a predetermined reference position in which the intermediate transfer belt 41 is spaced away from all the photoreceptor drums 31A to 31D.

As shown in FIG. 2B, during the monochrome image formation, the monochrome image forming primary transfer roller 34A is arranged in the pressing position while the color image forming primary transfer rollers 34B to 34D are arranged in the respective separating positions, so that the intermediate transfer belt 41 is arranged in a monochrome image forming position in which the intermediate transfer belt 41 is brought into pressure contact only with the monochrome image forming photoreceptor drum 31A and separated from the color image forming photoreceptor drums 31B to 31D.

As shown in FIG. 2C, during the color image formation, all the primary transfer rollers 34A to 34D are arranged in the respective pressing positions, so that the intermediate transfer belt 41 is arranged in a color image forming position in which the intermediate transfer belt 41 is brought into pressure contact with all the photoreceptor drums 31A to 31D.

Displacement of the primary transfer rollers 34A to 34D in the separating and contacting direction is performed by a separating and contacting mechanism 20.

The separating and contacting mechanism 20 is equipped with a first link member 21, a second link member 22, a cam 23, and a first to a fourth swinging members 24A, 24B, 24C, and 24D.

Along the moving direction 93 of the intermediate transfer belt 41, the cam 23 is arranged between the first link member 21 and the second link member 22. The first link member 21 and the second link member 22 are arranged so that the longitudinal direction of the first link member 21 and the second link member 22 may be arranged in parallel to the moving direction 93 and are freely movable within a predetermined range along the moving direction 93 of the intermediate transfer belt 41. The first link member 21 and the second link member 22 are each biased toward the cam 23 and brought into pressure contact with the cam 23.

Figure 3:
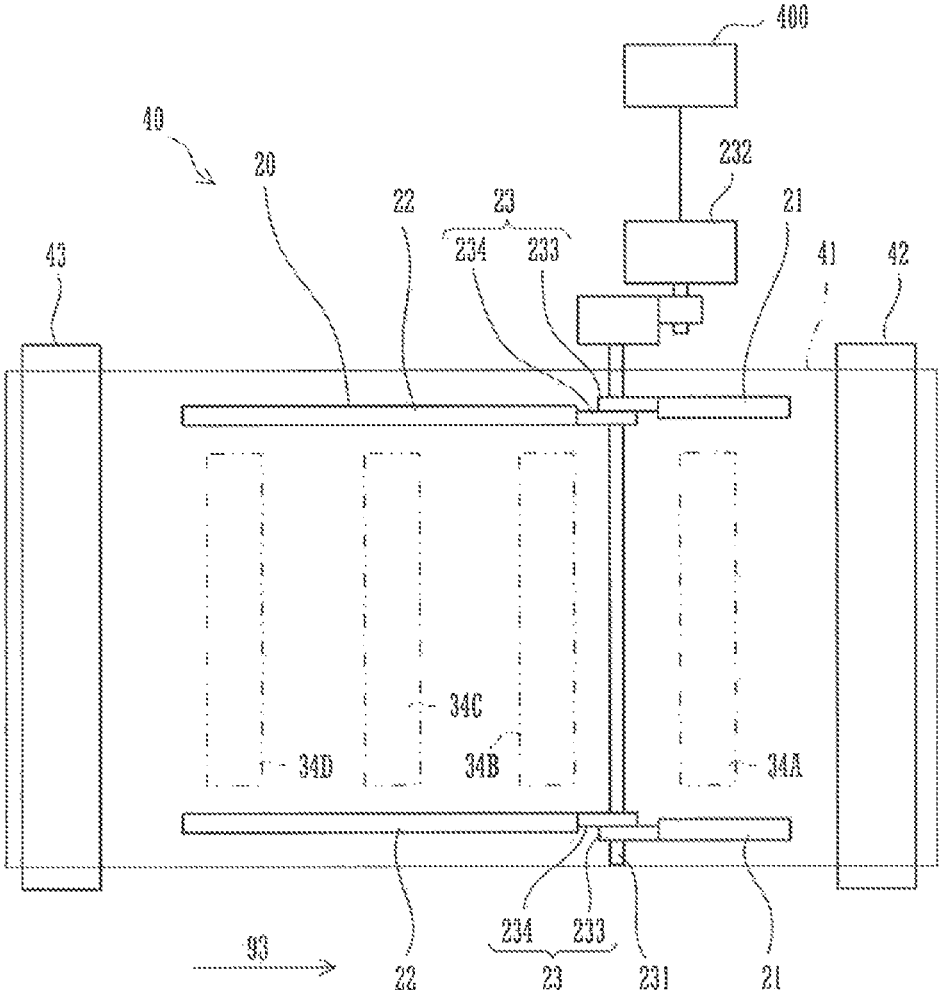
FIG. 3 is a schematic plan view of the intermediate transfer unit.

As shown in FIG. 3, the first link member 21, the second link member 22, and the cam 23 are arranged between the first stretching roller 42 and the second stretching roller 43 and on each of a front face side and a rear face side of the image forming apparatus 100. The primary transfer roller 34A is supported pivotally by the first link member 21 arranged on the front face side, and the first link member 21 arranged on the rear face side. The primary transfer rollers 34B to 34D are supported pivotally by the second link member 22 arranged on the front face side and the second link member 22 arranged on the rear face side, respectively.

The cam 23 on the front face side and the cam 23 on the rear face side are fixed on a single camshaft 231 and rotate around the camshaft 231 in the same phase with each other. The camshaft 231 is rotated by a driving force transmitted from a driving source 232. For example, as the driving source 232, a stepping motor may be used. The driving source 232 is controlled by a controller 400.

Figure 4A:
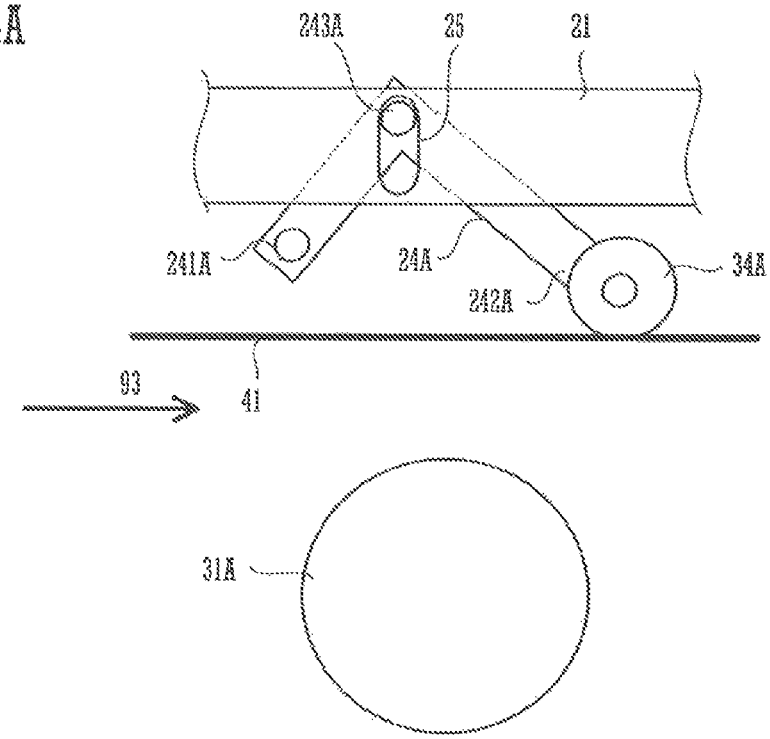
FIGS. 4A and 4B are partially enlarged views of the intermediate transfer unit.
Figure 4B:
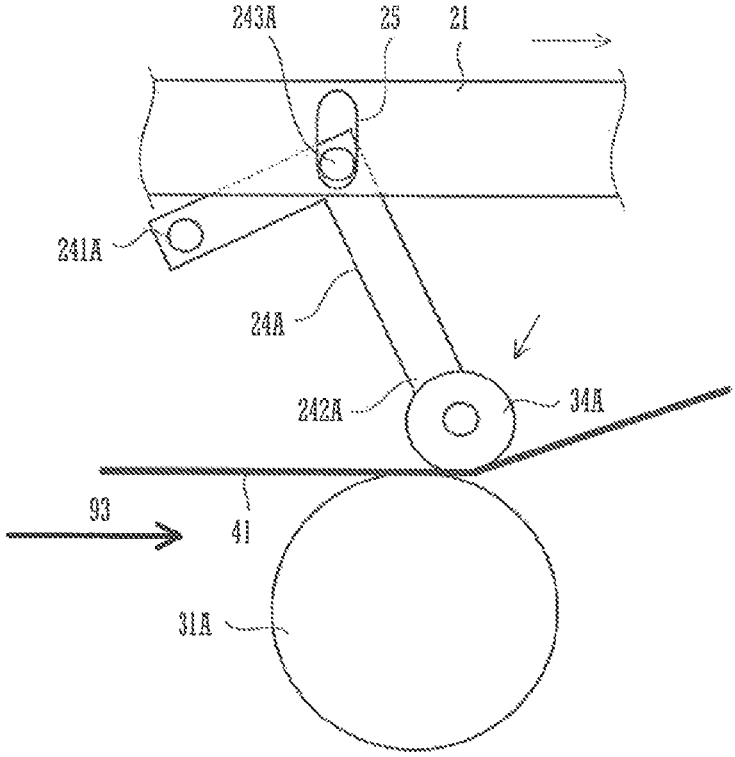

As shown in FIG. 4A and FIG. 4B, the first to the fourth swinging members 24A to 24D each are in a state of being bent in an L shape. The second to the fourth swinging members 24B to 24D are configured similar to the first swinging member 24A except for a mounting direction with respect to the second link member 22 in the moving direction 93. The second to the fourth swinging members 24B to 24D are mounted symmetrically in FIG. 2A, with respect to the first swinging member 24A.

The first end 241A of the first swinging member 24A is rotatably supported by a not-shown frame of the intermediate transfer unit 40, on a side closer to the photoreceptor drum 31A than to the first link member 21. The second end 242A of the first swinging member 24A rotatably supports the primary transfer roller 34A. Similarly, the respective first ends of the second to the fourth swinging members 24B to 24D are supported by the not-shown frame of the intermediate transfer unit 40, on a side closer to the photoreceptor drums 31B to 31D than to the second link member 22. The respective second ends of the second to the fourth swinging members 24B to 24D each rotatably support the primary transfer rollers 34B to 34D.

Figure 5:
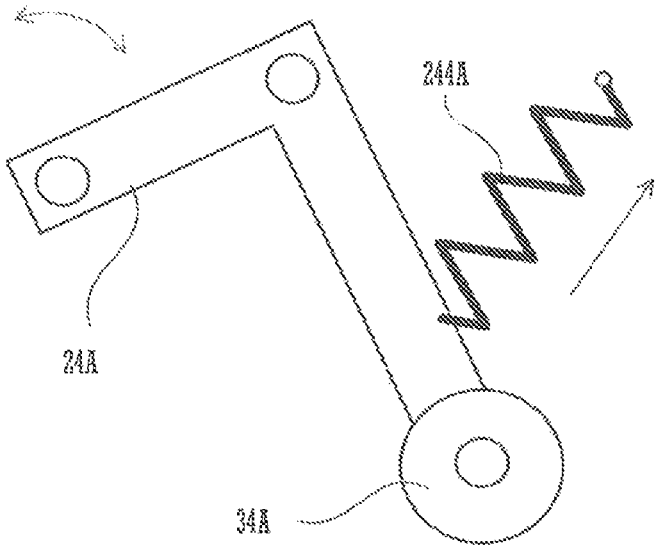
FIG. 5 is a configuration diagram of the primary transfer roller.

As shown in FIG. 5, the first swinging member 24A is biased by a spring 244A in a direction away from the photoreceptor drum 31A. Similarly, the second to the fourth swinging members 24B to 24D are each biased by a spring in a direction away from the photoreceptor drums 31B to 31D. It is to be noted that FIG. 4A and FIG. 4B omit the illustration of the spring 244A.

The first link member 21 has a slit 25 formed long in a direction perpendicular to the moving direction 93, in a position corresponding to the primary transfer roller 34A. The second link member 22 has a slit formed long in a direction perpendicular to the moving direction 93, in a position corresponding respectively to the primary transfer rollers 34B to 34D.

The first swinging member 24A has a bent portion provided with a projecting portion 243A projecting in a rotational axial direction of the primary transfer roller 34A. The projecting portion 243A is displaced within the slit 25 of the first link member 21 in the longitudinal direction of the slit 25. The second to fourth swinging members 24B to 24D have the respective projecting portions that are each displaced within respective slits of the second link member 22.

Therefore, as shown in FIG. 4B, as the first link member 21 moves in a direction away from the camshaft 231, that is, toward the downstream side in the moving direction 93 of the intermediate transfer belt 41, the projecting portion 243A descends within the slit 25 against an elastic force of the spring 244A, and the primary transfer roller 34A also descends and is displaced to the pressing position. Thus, the intermediate transfer belt 41 is pressed against the photoreceptor drum 31A. On the other hand, as shown in FIG. 4A, as the first link member 21 moves in a direction toward the camshaft 231, that is, toward the upstream side in the moving direction 93, the projecting portion 243A, by the elastic force of the spring 244A, ascends within the slit 25, and the primary transfer roller 34A also ascends and is displaced to the separating position. Thus, the intermediate transfer belt 41 is spaced away from the photoreceptor drum 31A.

Similarly, as the second link member 22 moves in a direction away from the camshaft 231, that is, toward the upstream side in the moving direction 93, the primary transfer rollers 34B to 34D descend to the respective pressing positions; and as the second link member 22 moves in the direction toward the camshaft 231, that is, toward the downstream side in the moving direction 93, the primary transfer rollers 34B to 34D ascend to the respective separating positions.

Figures 6A, 6B, 6C:
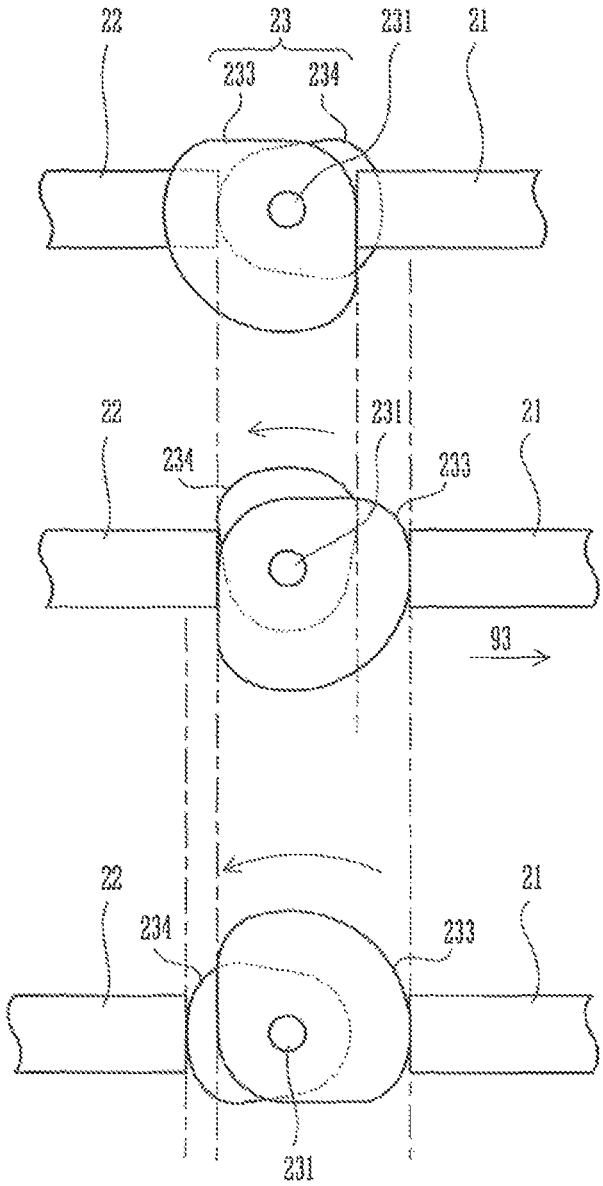
FIGS. 6A, 6B, and 6C are views illustrating a structure and arrangement states of a cam.

As shown in FIG. 6A to FIG. 6C, the cam 23 includes a first cam portion 233 and a second cam portion 234. The first cam portion 233 and the second cam portion 234 are fixed to the camshaft 231 in a position shifted along the camshaft 231, and rotate around the camshaft 231. The first link member 21 is brought into pressure contact with the acting peripheral face of the first cam portion 233. The second link member 22 is brought into pressure contact with the acting peripheral face of the second cam portion 234. The first cam portion 233 and the second cam portion 234 are each formed with an eccentric cam.

As shown in FIG. 6A, during the non-image formation, the cam 23 is arranged at a first predetermined angle. This makes both the first link member 21 and the second link member 22 move toward the camshaft 231. Therefore, all the primary transfer rollers 34A to 34D are arranged in the separating positions. Accordingly, the intermediate transfer belt 41 is arranged at the predetermined reference position spaced away from all the photoreceptor drums 31A to 31D.

As shown in FIG. 6B, during the monochrome image formation, the cam 23 is arranged at a predetermined second angle obtained by, on the basis of a state during the non-image formation, that is, the first predetermined angle, being rotated by 90 degrees in the counterclockwise direction in FIG. 6B. This causes the first link member 21 to be separated from the camshaft 231 and the second link member 22 to be contacted with the camshaft 231. Therefore, the monochrome image forming primary transfer roller 34A is displaced to the pressing position and the color image forming primary transfer rollers 34B to 34D are arranged in the respective separating positions. Thus, the intermediate transfer belt 41 is arranged in the monochrome image forming position in which the intermediate transfer belt 41 is brought into pressure contact only with the monochrome image forming photoreceptor drum 31A and spaced away from the color image forming photoreceptor drums 31B to 31D.

As shown in FIG. 6C, during the full-color image formation, the cam 23 is arranged at a predetermined third angle obtained by, on the basis of the state during the non-image formation, that is, the first predetermined angle, being rotated by 180 degrees in the counterclockwise direction in FIG. 6C. This causes both the first link member 21 and the second link member 22 to be separated from the camshaft 231. Therefore, all the primary transfer rollers 34A to 34D are arranged in the respective pressing positions. Accordingly, the intermediate transfer belt 41 is arranged in a color image forming position in which the intermediate transfer belt 41 is brought into pressure contact with all the photoreceptor drums 31A to 31D.

Figure 7:
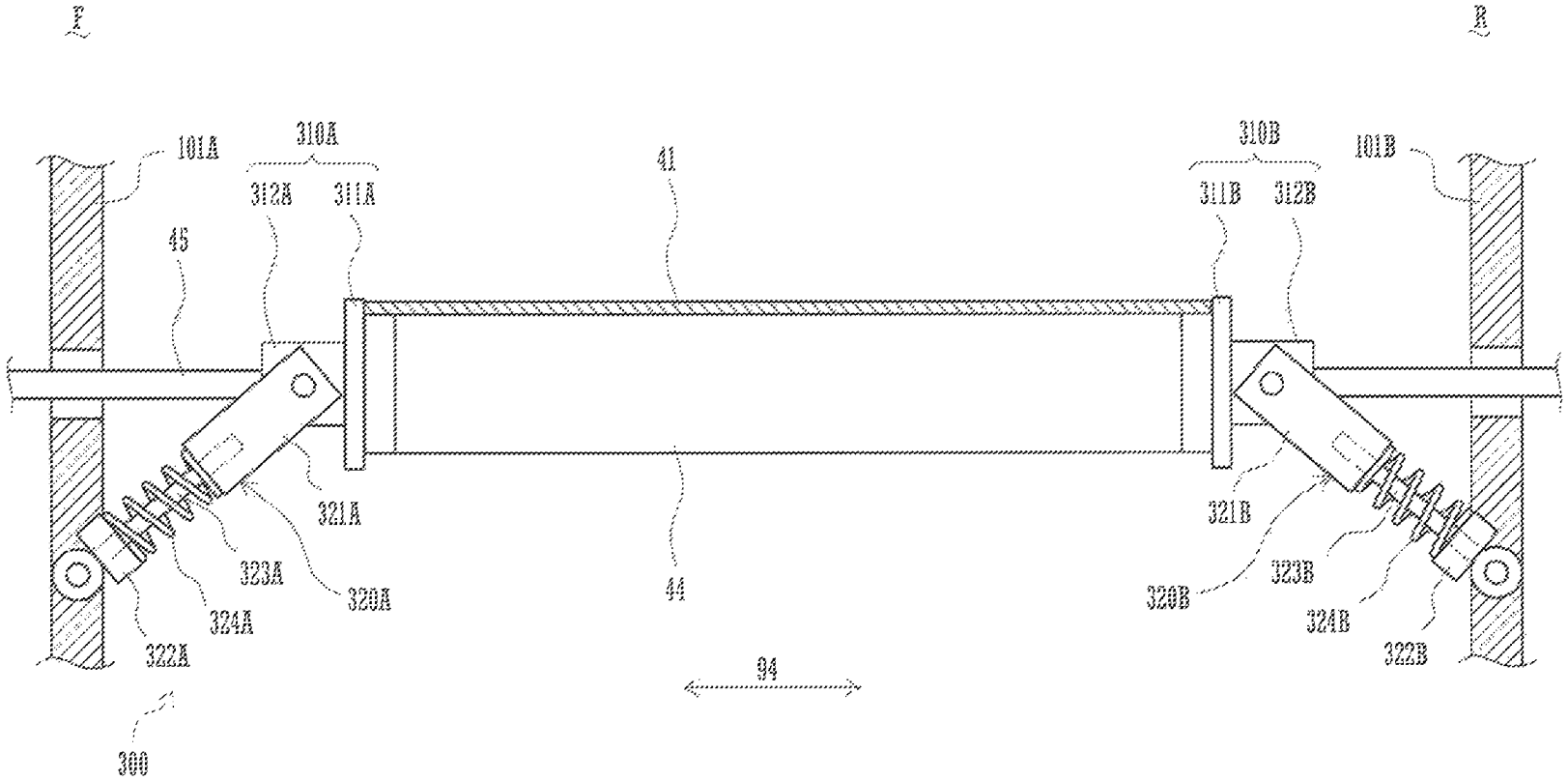
FIG. 7 is a side cross-sectional view of the intermediate transfer unit.

As shown in FIG. 7, the image forming apparatus 100 is further equipped with a meandering correction mechanism 300 for correcting the meandering of the intermediate transfer belt 41.

The meandering correction mechanism 300 includes deviation transfer members 310A and 310B and biasing members 320A and 320B. The deviation transfer members 310A and 310B are formed so as to move in an axial direction 94 by the deviation force of the intermediate transfer belt 41 in the axial direction of the tension roller 44. The meandering correction mechanism 300 is configured to bias the tension roller 44 in the direction in which the tensile force of the intermediate transfer belt 41 is increased and to increase and decrease a biasing force applied to each of the opposite end portions of the tension roller 44 according to an amount of movement in the axial direction 94 of the deviation transfer members 310A and 310B. Hereinafter, a specific example of the present invention will be described.

The tension roller 44 is supported by a shaft member 45 so as to freely rotate around the shaft member 45 and freely move along the shaft member 45.

The shaft member 45 is supported on apparatus frames 101A and 101B in such a manner that the opposite end portions of the shaft member 45 are independently movable in such a direction as to change the tensile force of the intermediate transfer belt 41, that is, in the vertical direction in FIG. 7. The shaft member 45 is restrained from rotating. As an example, in FIG. 7, the left side is the front face F side of the image forming apparatus 100 and the right side is the rear face R side of the image forming apparatus 100.

In the axial direction 94 of the tension roller 44, larger diameter members 311A and 311B are arranged so as to adjoin each of the opposite end portions of the tension roller 44. The larger diameter members 311A and 311B each have a larger diameter portion at an end located far from the tension roller 44 in the axial direction 94, the larger diameter portion being larger in diameter than the tension roller 44. The part of each of the larger diameter members 311A and 311B other than the larger diameter portion that extends in the axial direction 94 has the same diameter as the tension roller 54. The larger diameter members 311A and 311B are fitted over the shaft member 45 so as to freely move in the axial direction 94 and to be rotatably supported by the shaft member 45.

On the opposite side away from the tension roller 44 with respect to the larger diameter member 311A in the axial direction 94 arranged is a sliding member 312A. On the opposite side away from the tension roller 44 with respect to the larger diameter member 311B in the axial direction 94 arranged is a sliding member 312B. The sliding members 312A and 312B are fitted over the shaft member 45 in such a manner as to adjoin the larger diameter members 311A and 311B in the axial direction 94, respectively, and are movable in the axial direction 94. The sliding members 312A and 312B are restrained from rotating around the shaft member 45. The larger diameter member 311A and the sliding member 312A form one deviation transfer member 310A and the larger diameter member 311B and the sliding member 312B form the other deviation transfer member 310B.

The biasing member 320A includes a first bracket 321A, a second bracket 322A, a core rod 323A, and an elastic member 324A. The first bracket 321A is pivotally supported by the sliding member 312A. The second bracket 322A is pivotally supported on the apparatus frame 101A at a predetermined position on the opposite side of the tension roller 44 with respect to the pivot point of the first bracket 321A. More specifically, the biasing member 320A has an acting end and a base end, and the base end is pivotally supported on the apparatus frame 101A at the predetermined position on the opposite side of the tension roller 44 with respect to the acting end.

The core rod 323A has one end fixed to one of the first bracket 321A and the second bracket 322A and the other end displaceably inserted into the other bracket. As an example, the core rod 323A has one end fixed to the second bracket 322A and the other end displaceably inserted into the first bracket 321A. The elastic member 324A is arranged between the first bracket 321A and the second bracket 322A, and is externally attached to the core rod 323A. The elastic member 324A expands and contracts along the core rod 323A, so that the direction of the elastic force is not deviated even when the degree of contraction becomes large.

The biasing member 320B includes a first bracket 321B, a second bracket 322B, a core rod 323B, and an elastic member 324B and is configured similar to the biasing member 320A. The first bracket 321B is pivotally supported by the sliding member 312B. The second bracket 322B is pivotally supported on the apparatus frame 101B at a predetermined position on the opposite side of the tension roller 44 with respect to the pivot point of the first bracket 321B.

More specifically, the respective pivot points of the second brackets 322A and 322B are arranged, in the axial direction 94, closer to an end portion of the shaft member 45 than the pivot points of the first brackets 321A and 321B.

In this way, the biasing member 320A is arranged inclined in such a direction as to become gradually closer to the sliding member 312A from the end portion of the shaft member 45 toward a central portion of the shaft member 45 in the axial direction 94 of the tension roller 44. Similarly, the biasing member 320B is arranged inclined in such a direction as to become gradually closer to the sliding member 312B from the end portion of the shaft member 45 toward the central portion of the shaft member 45 in the axial direction 94.

Additionally, the respective pivot points of the second brackets 322A and 322B are arranged on the opposite side of the intermediate transfer belt 41 with respect to the shaft member 45. Therefore, the biasing members 320A and 320B bias the shaft member 45 in such a direction as to increase the tensile force of the intermediate transfer belt 41.

Figure 8:
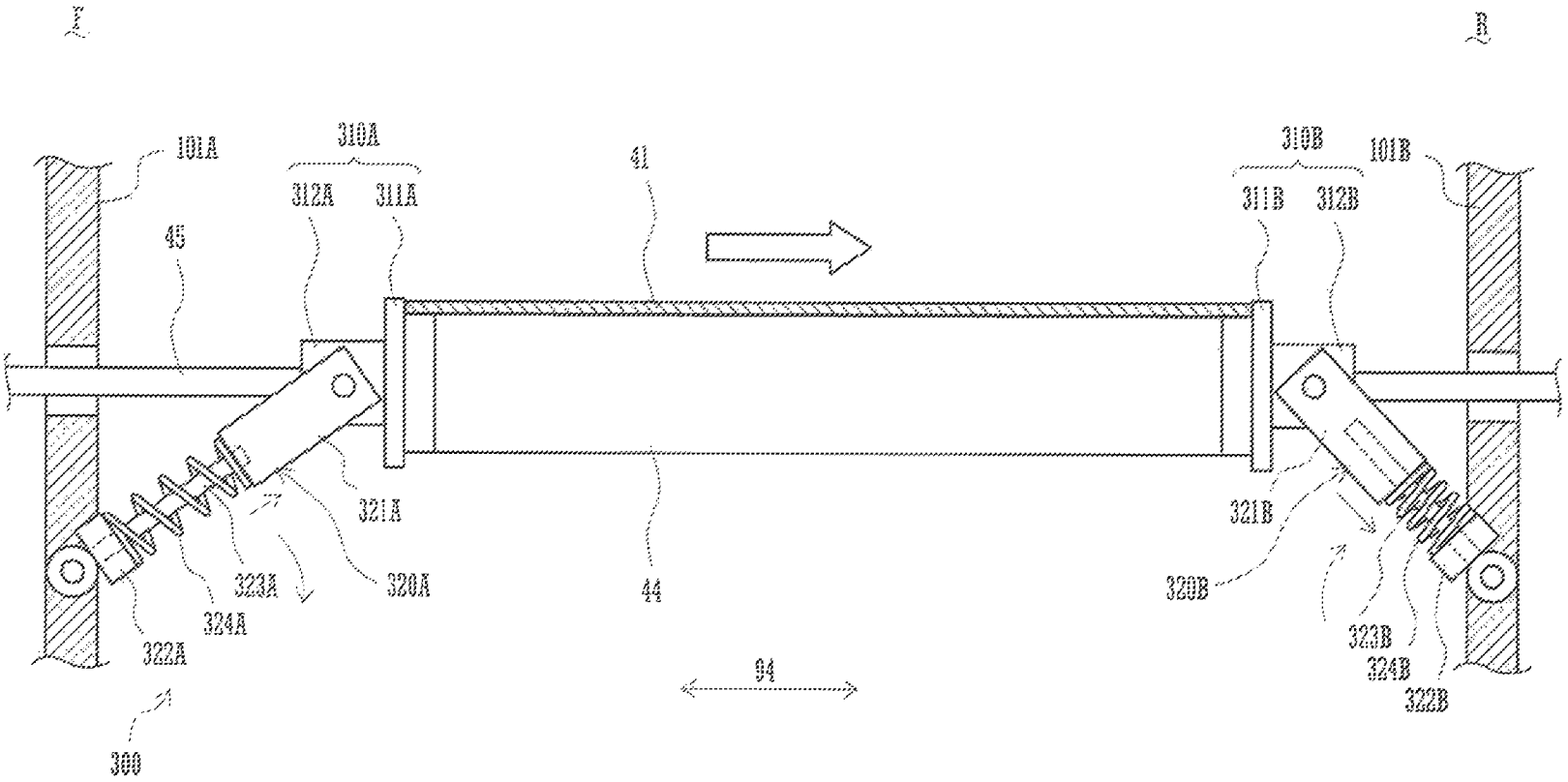
FIG. 8 is a view illustrating a state in which an intermediate transfer belt is deviated toward a rear face side.

FIG. 8 illustrates a state in which the intermediate transfer belt 41 is deviated from an ideal position of the width direction in which the intermediate transfer belt 41 has to run, that is, a state in which the intermediate transfer belt 41 is meandering. When the intermediate transfer belt 41 meanders to deviate toward one side in the axial direction 94, toward the rear face R side, for example, a widthwise end portion of the intermediate transfer belt 41 presses against the larger diameter portion of the larger diameter member 311B, thereby moving the deviation transfer member 310B, which is arranged on the downstream side in the deviation direction, toward the rear face R side along the shaft member 45.

Accordingly, the angle of inclination of the biasing member 320B on the downstream side in the deviation direction relative to the axial direction 94 becomes closer to the angle perpendicular to the axial direction 94, thereby causing the degree of contraction of the biasing member 320B to increase. Therefore, on the downstream side in the deviation direction of the intermediate transfer belt 41 in the axial direction 94 of the tension roller 44, that is, on the rear face R side, a pressing force of the biasing member 320B against the shaft member 45 increases, thereby causing the tensile force of the intermediate transfer belt 41 to increase.

The deviation transfer member 310A arranged on the upstream side in the deviation direction also moves toward the downstream side in the deviation direction by the elastic force of the biasing member 320A in association with the deviation of the intermediate transfer belt 41. Thus, the angle of inclination of the biasing member 320A on the upstream side in the deviation direction relative to the axial direction 94 becomes closer to the angle of the axial direction 94, thereby causing the degree of contraction of the biasing member 320A to decrease. Therefore, on the upstream side in the deviation direction of the intermediate transfer belt 41 in the axial direction 94, the pressing force of the biasing member 320A against the deviation transfer member 310A decreases, thereby causing the tensile force of the intermediate transfer belt 41 to decrease.

An endless belt having no stretch property has a property of moving from a side with a high tensile force toward a side with a low tensile force, so that the intermediate transfer belt 41 moves toward the front face F side. In this way, the meandering of the intermediate transfer belt 41 toward the rear face R side is corrected.

Figure 9:
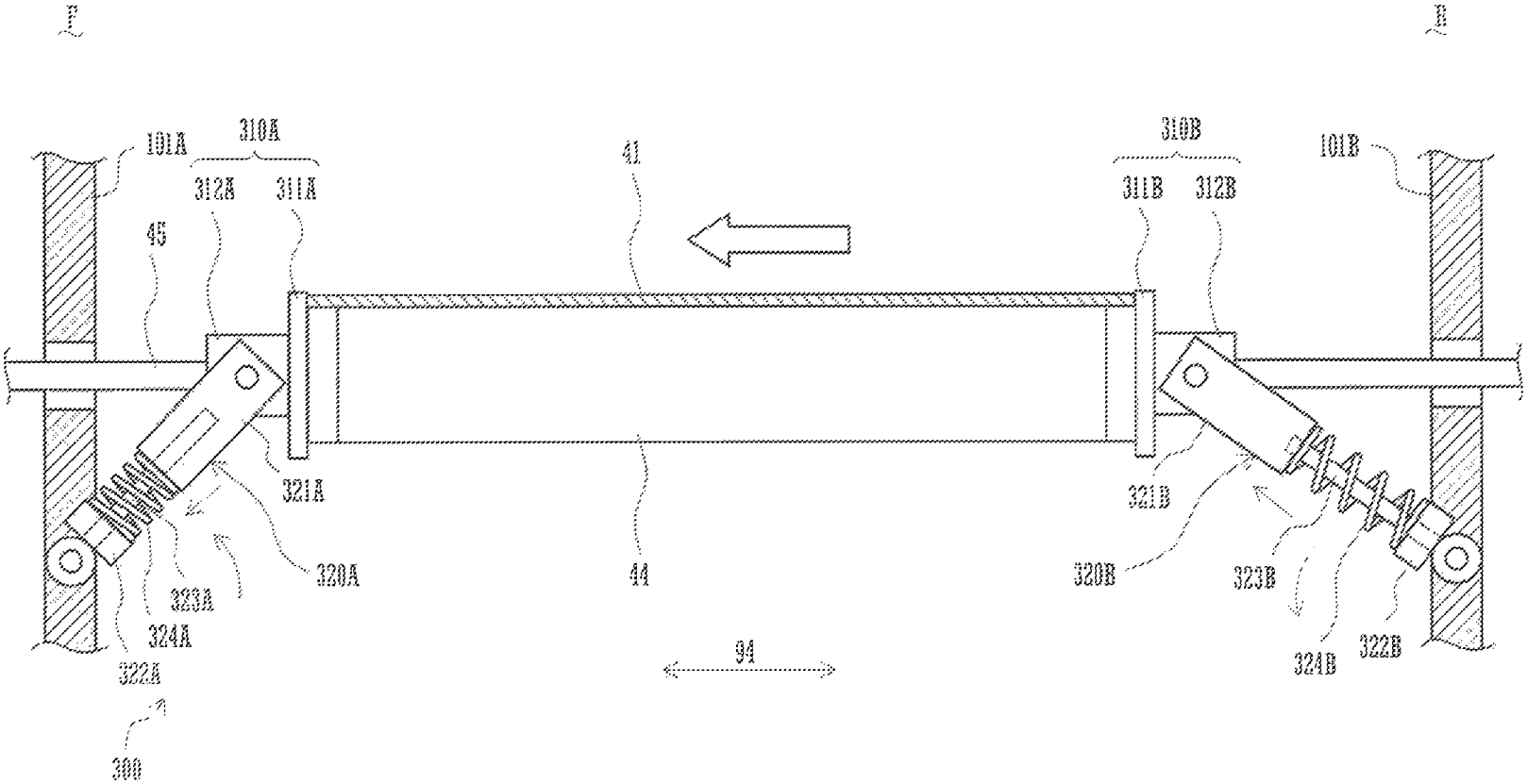
FIG. 9 is a view illustrating a state in which the intermediate transfer belt is deviated toward a front face side.

FIG. 9 illustrates a state in which the intermediate transfer belt 41 is meandering toward the front face F side. As in the case of FIG. 8, when the intermediate transfer belt 41 meanders to deviate toward the front face F side, the widthwise end portion of the intermediate transfer belt 41 presses against the larger diameter portion of the larger diameter member 311A, thereby moving the deviation transfer member 310A, which is located on the downstream side in the deviation direction, that is, on the front face F side, toward the front face F side along the shaft member 45. Thus, the degree of contraction of the biasing member 320A on the downstream side in the deviation direction increases, thereby causing the tensile force of the intermediate transfer belt 41 to increase on the front face F side. In addition, on the upstream side in the deviation direction, that is, on the rear face R side, the tensile force of the intermediate transfer belt 41 is decreased. Therefore, the intermediate transfer belt 41 moves toward the rear face R side. In this way, the meandering of the intermediate transfer belt 41 toward the front face F side is corrected.

As described above, when the intermediate transfer belt 41 meanders to press against the larger diameter portions of the larger diameter members 311A and 311B, the tensile force of the intermediate transfer belt 41 is increased on the downstream side in the deviation direction and also decreased on the upstream side in the deviation direction, so that the widthwise position of the intermediate transfer belt 41 is maintained at a position at which a force to move the intermediate transfer belt 41 toward the front face F side and the force to move the intermediate transfer belt 41 toward the rear face R side are balanced with each other.

Moreover, the meandering of the intermediate transfer belt 41 can be corrected by means of a simple mechanism that does not require a sensor or an electric circuit for detecting the amount of deviation of the intermediate transfer belt 41.

Furthermore, a rotating direction of the biasing member 320A rotating around the pivot point of the second bracket 322A and a rotating direction of the biasing member 320B rotating around the pivot point of the second bracket 322B are different from a running direction of a portion of the intermediate transfer belt 41 that is in pressure contact with the tension roller 44, so that, even when the amount of deviation of the intermediate transfer belt 41 becomes large, the biasing members 320A and 320B fail to rotate by a running force of the intermediate transfer belt 41. Accordingly, the tensile force imparted by the tension roller 44 to the intermediate transfer belt 41 cannot be undesirably decreased in the extreme. For this reason, the meandering of the intermediate transfer belt 41 can be stably corrected.

The plane containing the rotating loci of the biasing members 320A and 320B rotating around the respective base end portions is preferably perpendicular to the running direction of the portion of the intermediate transfer belt 41, the portion being in pressure contact with the tension roller 44. This makes it possible to more reliably prevent the biasing members 320A and 320B from rotating by the running force of the intermediate transfer belt 41 even when the amount of deviation of the intermediate transfer belt 41 becomes large. Therefore, the meandering of the intermediate transfer belt 41 can be more stably corrected.

In addition, since the larger diameter members 311A and 311B are freely rotatable, the friction between the intermediate transfer belt 41 and the larger diameter members 311A and 311B is reduced, which will reduce wear of the opposite end portions of the intermediate transfer belt 41.

Moreover, the sliding members 312A and 312B that are restrained from rotating pivotally support the respective acting ends of the biasing members 320A and 320B, so that, when the amount of deviation of the intermediate transfer belt 41 has some value, the arrangement and the degree of contraction of the biasing members 320A and 320B become stable, which will further improve the precision of the meandering correction of the intermediate transfer belt 41.

It should be noted that, when, of the deviation transfer members 310A and 310B, at least the deviation transfer member that is arranged on the downstream side in the deviation direction in the axial direction 94 of the intermediate transfer belt 41 moves in the axial direction 94 together with the intermediate transfer belt 41, the effect of correcting the meandering of the intermediate transfer belt 41 will be achieved. Likewise, when the deviation transfer member arranged on the upstream side in the deviation direction moves in the axial direction 94 together with the intermediate transfer belt 41, the meandering of the intermediate transfer belt 41 can be corrected more effectively.

Additionally, the larger diameter members 311A and 311B can be formed integrally with the tension roller 44.

Subsequently, in the image forming apparatus 100 equipped with the meandering correction mechanism 300 configured as described above, even when, during the non-image forming period, the amount of meandering per unit time of the intermediate transfer belt 41, that is, the amount of movement in the axial direction 94 of the intermediate transfer belt 41 is small and the deviation force of the intermediate transfer belt 41 is small, the configuration to suppress the deviation transfer members 310A and 310B from failing to move and the moving start timing of the deviation transfer members 310A and 310B from being delayed will be described below.

Figure 10:
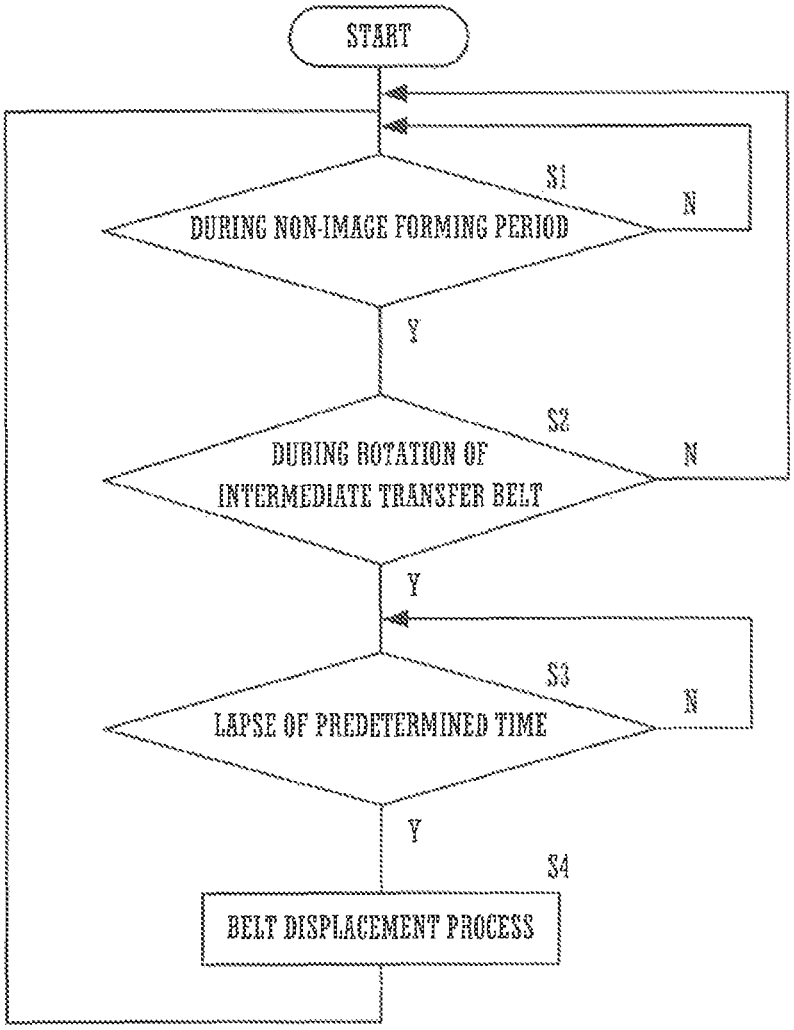
FIG. 10 is a flowchart illustrating process steps performed by a controller.

As shown in FIG. 10, the controller 400, during the non-image forming period (S1), during rotation of the intermediate transfer belt 41 (S2), at a timing when a predetermined time has passed since rotation start of the intermediate transfer belt 41 and at a timing when a predetermined time has passed since the execution of the previous belt displacement process (S3), executes the belt displacement process (S4).

The controller 400, as the belt displacement process, controls the separating and contacting mechanism 20 so as to displace the intermediate transfer belt 41 from a predetermined reference position shown in FIG. 2A in which the intermediate transfer belt 41 is spaced away from all of the plurality of photoreceptor drums 31A to 31D, and then return the intermediate transfer belt 41 to the reference position. The time required for one belt displacement process is several hundreds of milliseconds as an example.

During the non-image forming period and during rotation of the intermediate transfer belt 41, the belt displacement process is executed at every predetermined time, which changes the tensile force of the intermediate transfer belt 41 and transmits vibration to the meandering correction mechanism 300. Therefore, even when the deviation force of the intermediate transfer belt 41 is small, the deviation transfer members 310A and 310B are easily moved by the deviation force of the intermediate transfer belt 41. Thus, the biasing force applied to each of the opposite end portions of the tension roller 44 is precisely increased and decreased according to the amount of movement in the axial direction 94 of the deviation transfer members 310A and 310B. Accordingly, it is possible to improve the precision of the meandering correction of the intermediate transfer belt 41 during the non-image forming period.

Since the belt displacement process is executed during the non-image forming period, the precision of the meandering correction of the intermediate transfer belt 41 can be improved without adversely affecting the efficiency of the image formation and the image quality.

In a first preferred embodiment, the controller 400 may preferably be configured, when executing the belt displacement process, to displace the intermediate transfer belt 41 from the reference position to at least either one of a monochrome image forming position in which the intermediate transfer belt 41 is contacted only with a monochrome image forming photoreceptor drum 31A among the plurality of photoreceptor drums 31A to 31D and a color image forming position in which the intermediate transfer belt 41 is contacted with all of the plurality of photoreceptor drums 31A to 31D.

Since the intermediate transfer belt 41 can be displaced between the monochrome image forming position, the color image forming position, and the reference position, and a special structure is not required as the separating and contacting mechanism 20, the precision of meandering correction of the intermediate transfer belt 41 can be improved at low cost.

Specific examples of the belt displacement process according to the first preferred embodiment of the present invention include the following four examples. More specifically, in a first example, the displacement is performed in the order of the reference position, the monochrome image forming position, the color image forming position, and the reference position. In a second example, the displacement is performed in the order of the reference position, the color image forming position, the monochrome image forming position, and the reference position. In a third example, the displacement is performed in the order of the reference position, the color image forming position, and the reference position. In a fourth example, the displacement is performed in the order of the reference position, the monochrome image forming position, and the reference position.

Of the above-stated four examples, like the fourth example, the displacement in the order of the reference position, the monochrome image forming position, and the reference position is most preferred. The reason is that, in execution of the displacement process, only the monochrome image forming primary transfer roller 34A can be displaced and the color image forming primary transfer rollers 34B to 34D are not necessary to be displaced, so that the burden against the separating and contacting mechanism 20 is small.

In a second preferred embodiment, the controller 400 may preferably be configured, when executing the belt displacement process, to displace the intermediate transfer belt 41 from the reference position to a spaced position in which the intermediate transfer belt 41 is spaced away from all of the plurality of photoreceptor drums 31A to 31D, the spaced position being a predetermined spaced position that is at least partially different from the reference position illustrated in FIG. 2A.

Since the intermediate transfer belt 41 is displaced from the reference position to a predetermined spaced position located between the reference position and a position in which the intermediate transfer belt 41 contacts the photoreceptor drums 31A to 31D, as compared with a case in which the intermediate transfer belt 41 is displaced to a position in which the intermediate transfer belt 41 contacts the photoreceptor drums 31A to 31D, the displacement distance of the intermediate transfer belt 41 is shorter, which enables the belt displacement process to be completed in a short time.

Furthermore, since the intermediate transfer belt 41 does not contact the photoreceptor drums 31A to 31D, the residual toner of the photoreceptor drums 31A to 31D does not adhere to the intermediate transfer belt 41. Therefore, the deterioration of the image quality can be suppressed.

More specifically, the controller 400 may preferably be configured, when executing the belt displacement process, to displace the intermediate transfer belt 41 from the reference position to at least either one of a first spaced position in which the intermediate transfer belt 41 is close only to the monochrome image forming photoreceptor drum 31A among the plurality of photoreceptor drums 31A to 31D and a second spaced position in which the intermediate transfer belt 41 is close to all of the plurality of photoreceptor drums 31A to 31D.

The intermediate transfer belt 41 can be thus displaced to the first spaced position by being displaced from the reference position to a point halfway to the monochrome image forming position, and can be displaced to the second spaced position by being displaced from the reference position to a point halfway to the color image forming position. Therefore, since the intermediate transfer belt 41 can be displaced between the monochrome image forming position, the color image forming position, and the reference position, and a special structure is not required as the separating and contacting mechanism 20, the precision of meandering correction of the intermediate transfer belt 41 can be improved at low cost.

Specific examples of the belt displacement process according to the second preferred embodiment of the present invention include the following four examples. Specifically, in a first example, the displacement is performed in the order of the reference position, the first spaced position, the second spaced position, and the reference position. In a second example, the displacement is performed in the order of the reference position, the second spaced position, the first spaced position, and the reference position. In a third example, the displacement is performed in the order of the reference position, the second spaced position, and the reference position. In a fourth example, the displacement is performed in the order of the reference position, the first spaced position, and the reference position.

Of the above-stated four examples of the second preferred embodiment, like the fourth example, the displacement in the order of the reference position, the first spaced position, and the reference position is most preferred. The reason is that, in execution of the displacement process, only the monochrome image forming primary transfer roller 34A may be displaced and the color image forming primary transfer rollers 34B to 34D are not necessary to be displaced, so that the burden against the separating and contacting mechanism 20 is small.

It is to be noted that, in one belt displacement process, the operation in which the intermediate transfer belt is displaced from the reference position and then returned to the reference position can also be configured to be repeated multiple times.

The belt displacement process can be configured so as to be executed at a time of at least one of maintenance accompanied by toner supply and adjustment of toner density.

While maintenance accompanied by toner supply is performed during a non-image forming period and, during the maintenance accompanied by toner supply, the intermediate transfer belt 41 is rotated for a long time, the execution of the belt displacement process can improve the precision of the meandering correction of the intermediate transfer belt 41 without adversely affecting the efficiency of image formation and image quality.

Similarly, while adjustment of toner density is performed during a non-image forming period and, during the adjustment of toner density, the intermediate transfer belt 41 is rotated for a long time, the execution of the belt displacement process can improve the precision of the meandering correction of the intermediate transfer belt 41 without adversely affecting the efficiency of image formation and image quality.

The foregoing preferred embodiments are to be considered in all respects as illustrative and not restrictive. The scope of the present invention is defined by the following claims, not by the foregoing embodiments. Further, the scope of the present invention is intended to include the scopes of the claims and all possible changes and modifications within the senses and scopes of equivalents.

REFERENCE SIGNS LIST

20 Separating and contacting mechanism
31A to 31D Photoreceptor drum (image bearing member)
34A to 34D Primary transfer roller
40 Intermediate transfer unit
41 Intermediate transfer belt
42 First stretching roller
43 Second stretching roller
44 Tension roller
45 Shaft member
93 Moving direction
94 Axial direction
100 Image forming apparatus
300 Meandering correction mechanism
310A, 310B Deviation transfer member
311A, 311B larger diameter member
312A, 312B Sliding member
320A, 320B Biasing member
400 Controller

The invention claimed is:

1. An image forming apparatus comprising:

a plurality of image bearing members that is configured to bear a toner image on each of plurality of the image bearing members;

an endless intermediate transfer belt onto which the toner image is transferred from at least one of the plurality of image bearing members during image formation;

a separating and contacting mechanism that displaces the intermediate transfer belt in a separating and contacting direction with respect to each of the plurality of image bearing members;

a plurality of stretching rollers over which the intermediate transfer belt is stretched, the stretching rollers including:

a driving roller that rotates the intermediate transfer belt; and a tension roller of which opposite end portions in an axial direction are independently movable in a direction in which a tensile force of the intermediate transfer belt is changed;

a meandering correction mechanism that biases the tension roller in a direction in which the tensile force of the intermediate transfer belt is increased, that includes a deviation transfer member moving along the axial direction by a deviation force of the intermediate transfer belt along the axial direction, and that increases and decreases a biasing force applied to each of the opposite end portions according to an amount of movement along the axial direction of the deviation transfer member; and a controller that executes, at a predetermined timing during rotation of the intermediate transfer belt during a non-image forming period, a belt displacement process in which the separating and contacting mechanism is controlled so that the intermediate transfer belt is displaced from a predetermined reference position in which the intermediate transfer belt is spaced away from all of the plurality of image bearing members and then is returned to the reference position.

2. The image forming apparatus according to claim 1, wherein the controller, when executing the belt displacement process, displaces the intermediate transfer belt from the reference position to at least either one of a monochrome image forming position in which the intermediate transfer belt is contacted only with a monochrome image bearing member among the plurality of image bearing members and a color image forming position in which the intermediate transfer belt is contacted with all of the plurality of image bearing members.

3. The image forming apparatus according to claim 1, wherein the controller, when executing the belt displacement process, displaces the intermediate transfer belt from the reference position to a spaced position in which the intermediate transfer belt is spaced away from all of the plurality of image bearing members, the spaced position being a predetermined spaced position that is at least partially different from the reference position.

4. The image forming apparatus according to claim 3, wherein the controller, when executing the belt displacement process, displaces the intermediate transfer belt from the reference position to at least either one of a first spaced position in which the intermediate transfer belt is close only to a monochrome image bearing member among the plurality of image bearing members and a second spaced position in which the intermediate transfer belt is close to all of the plurality of image bearing members.

5. The image forming apparatus according to claim 1, further comprising a shaft member that supports the tension roller to be rotatable as well as movable along the axial direction, wherein the meandering correction mechanism includes two deviation transfer members;

wherein the two deviation transfer members are arranged so as to be adjacent to each of the opposite end portions of the tension roller in the axial direction;

wherein each of the two deviation transfer members has a larger diameter member that is larger in diameter than the tension roller and is fitted over the shaft member movably along the axial direction; and wherein the meandering correction mechanism further includes a biasing member that biases the shaft member in the direction in which the tensile force of the intermediate transfer belt is increased, the biasing member including:

an acting end pivotally supported by the deviation transfer member; and a base end pivotally supported at a predetermined position of an apparatus frame.

6. The image forming apparatus according to claim 5,

Wherein each of the two deviation transfer members further comprises a sliding member that is restricted from rotating around the shaft member on an opposite side of the tension roller with respect to the larger diameter member in the axial direction; and wherein the acting end is pivotally supported by the sliding member on the opposite side.

* * * * *